US007813657B2

(12) United States Patent
Scheuer et al.

(10) Patent No.: US 7,813,657 B2
(45) Date of Patent: Oct. 12, 2010

(54) TONER CONCENTRATION FIELD MEASUREMENT TOOL

(75) Inventors: Mark A Scheuer, Williamson, NY (US); Mark S Petrush, Webster, NY (US); Steven R Leroy, Hilton, NY (US)

(73) Assignee: Xerox Corporation, Norwalk, CT (US)

( * ) Notice: Subject to any disclaimer, the term of this patent is extended or adjusted under 35 U.S.C. 154(b) by 441 days.

(21) Appl. No.: 12/028,022

(22) Filed: Feb. 8, 2008

(65) Prior Publication Data

US 2009/0202264 A1 Aug. 13, 2009

(51) Int. Cl.
*G03G 15/01* (2006.01)

(52) U.S. Cl. ..... 399/27; 399/30

(58) Field of Classification Search ..... 399/30, 399/60, 253, 411, 27
See application file for complete search history.

(56) References Cited

U.S. PATENT DOCUMENTS 5,143,222 A * 9/1992 Monteith ..... 209/364
5,166,729 A 11/1992 Rathbun et al.
5,521,690 A * 5/1996 Taffler et al. ..... 399/93
6,377,760 B1 4/2002 Hagiwara
6,931,219 B2 8/2005 Viturro et al.
7,006,778 B2 * 2/2006 Mitchell et al. ..... 399/253
7,706,726 B2 * 4/2010 Van der Werf et al. ..... 399/253

* cited by examiner

*Primary Examiner*—David M Gray
*Assistant Examiner*—Barnabas T Fekete

(57) ABSTRACT

A tool used in the TC measurement in the field includes a venturi shaped container that when connected to vacuum pressure from a portable vacuum cleaner takes advantage of cyclone separator functionality to assist in separation of fine toner from carrier beads with the toner being caught in the vacuum cleaner and the carrier beads being caught by a plurality of screens covering an opening in the bottom of the container.

20 Claims, 2 Drawing Sheets

TONER CONCENTRATION FIELD MEASUREMENT TOOL

The present disclosure is related to a toner concentration (TC) measurement device and method that measures the concentration of toner used in electrostatic printing machines.

Electrostatographic machines including printers and copiers form a latent image on the surface of photosensitive material which is identical with an original image, brings toner-dispersed developer into contact with the surface of the photosensitive material, and sticks toner particles only onto the latent image with electrostatic force to form a copied image on a copy sheet. In order to maintain the copy quality of the image transferred to the copy sheet, there are several types of toner concentration measuring devices.

One such device is in U.S. Pat. No. 6,377,760 where a toner concentration apparatus is shown that measures TC by providing first and second light guiding devices whose end surfaces project into a duct traversed by developer fluid and a light receiving device for receiving light transmitted from the first light guiding device to the second light guiding device. In U.S. Pat. No. 6,931,219 an apparatus and method is disclosed for determining TC of a sample comprised of toner and carrier that includes exposing the sample to light; the exposing includes emitting light at a predefined wavelength based upon the color of the toner; detecting the light reflected off the sample with an optical sensor and determining the TC of the sample base upon the light reflected off the sample. These techniques are directed to in-machine TC testing and do not answer problems encountered when measuring TC in the field and separate and apart from a machine. The heretofore mentioned references are included herein by reference to the extent necessary to practice the present disclosure.

The measurement of TC in the field by a technical representative is presently done by indirect means, for example, as shown in U.S. Pat. No. 5,166,729, and with limited results since measurement of clear and shades of gray toner are difficult, if not impossible, to sense relative to gray carrier.

Heretofore, TC has been measured in the laboratory by blowing toner off of carrier which, in turn, is kept captive in a metal cage. By measuring the weight of the cage, the cage with developer, and the cage with carrier only, the TC is easily calculated. Putting the laboratory measurement into the field has proven to be very difficult because the laboratory measurement device is too large, cumbersome and expensive to be used by each technical representative in the field. For example, laboratory scales cost over $1000.00 and are not meant for travel. Removing the toner from the carrier is non-trivial, and proper handling of materials in customer sites has been troublesome. Hence, there is still a need for an efficient, low cost method and apparatus that can be used to measure TC in the field.

In answer thereto and disclosed hereinafter is method and apparatus for direct gravimetric measurement of TC in the field that is simple, cost effective and compact that includes a molded conductive plastic developer container with an entry nozzle for air and series of screens strategically positioned therein to cover an open portion in the bottom thereof. A portable vacuum cleaner adapted to fit around the bottom portion of the container. The developer container is configured to take advantage of cyclone separator functionality with screen filtration creating a vortex with applied pressures from the vacuum cleaner to assist in separation of the fine toner from the coarser, high density particles.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
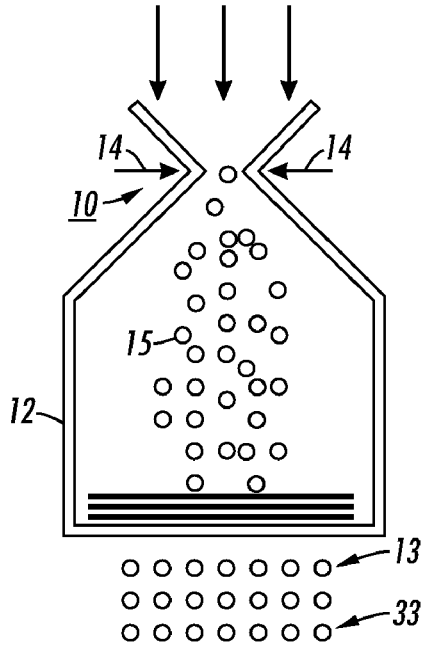
FIG. 1 is a frontal view of an exemplary weighing cage that includes the improved design of the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes a method of loading multiple types of paper in a feed tray to allow printing of multiple jobs without operator intervention.

For a general understanding of the features of the disclosure, reference is made to the drawings. In the drawings, like reference numerals have been used throughout to identify identical elements.

Figure 2:
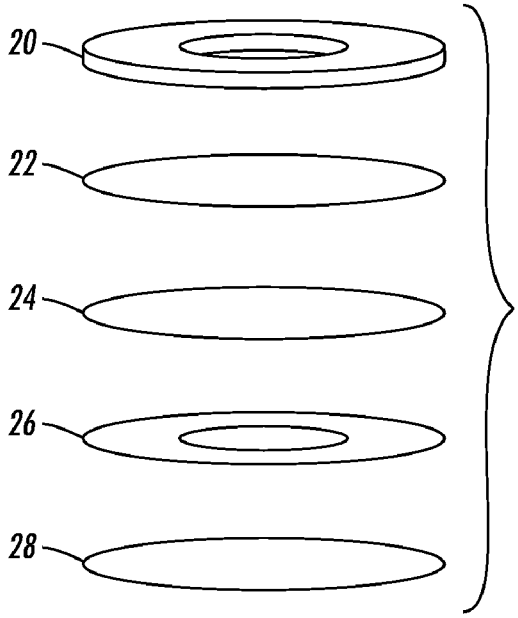
FIG. 2 is an isometric view of filters, screens and a seal that filter toner from carrier as it is evacuated from the cage of FIG. 1.
Figure 3:
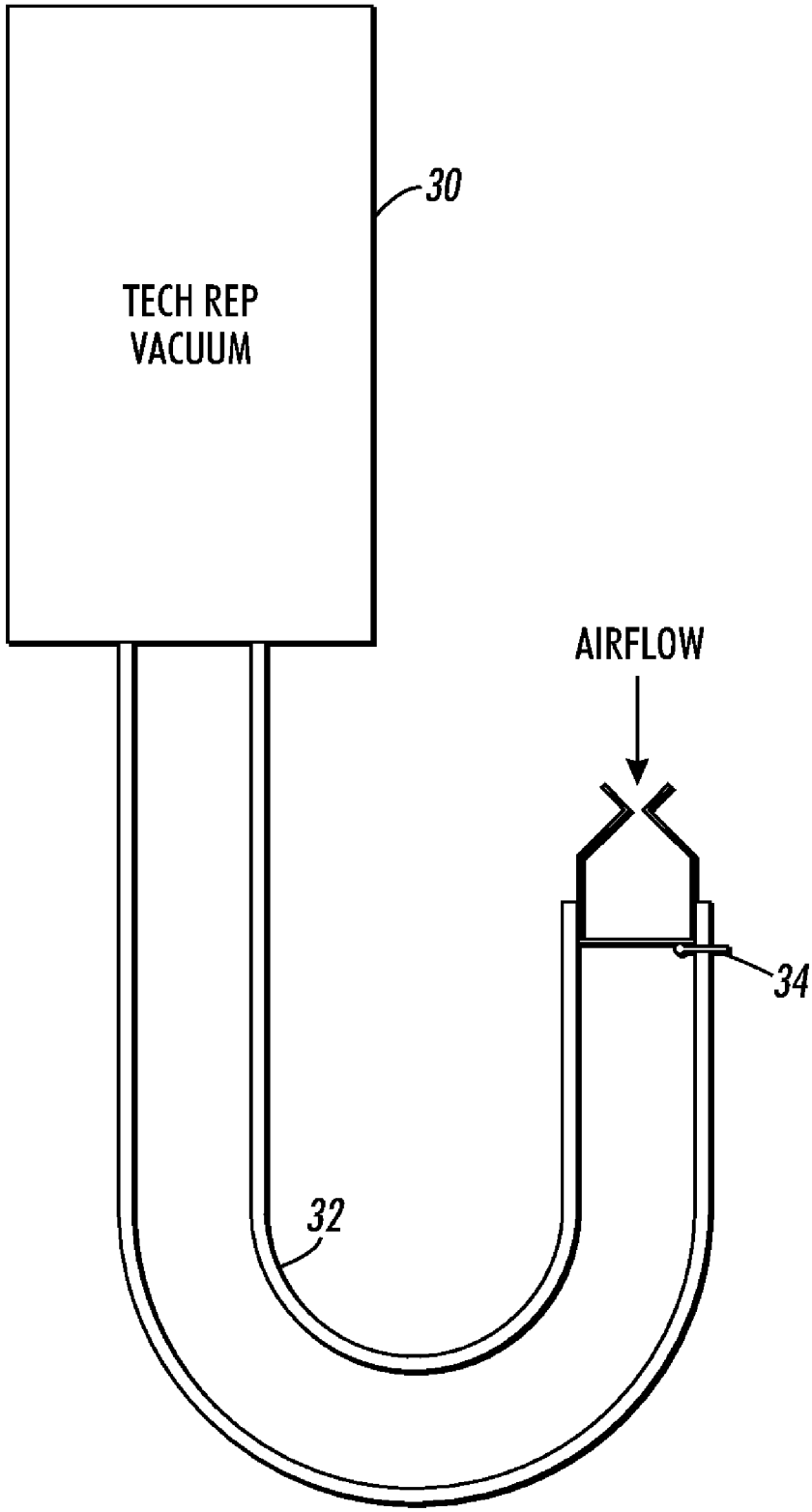
FIG. 3 is a frontal view of the weighing cage of FIG. 1 connected to a vacuum source.

Referring now to FIGS. 1-3, parts of a field measurement kit are disclosed for measuring TC in the field. In FIG. 1, cage 12 is a molded conductive plastic unit that preferably weighs less than 25 g. The cage has an open end that narrows to a throat area of about 5 mm located between arrows 14 that widens out to a straight cylindrical portion that preferably provides volume for a toner 13/carrier 15 sample of about 1-3 g. The throat area of the venturi shaped cage is structured to accelerate airflow therethrough which will strip toner off the carrier beads as air is drawn through the open end of the cage. The venturi shape is critical. The streamlined shape keeps the sides free of toner. Any stagnation point in the interior will provide a surface for toner to collect. Carrier beads 15 are airborne during the toner removal stage and will scrape toner that lands on the sides, which can occur when the vacuum is turned ON. The beads form a tornado shape inside the cage and rise to the neck of the venturi. The cage has a partially open end at the bottom thereof that is covered by a set of screens as shown in FIG. 2. The set of screens at the base of the cage contain the carrier beads and allow the toner to pass out of the cage and prevent bead leakage. The screens consists of a coarse screen 28 to support the other screens, a steel washer 26 to protect the 500 mesh screen 24 from being damaged by contact with the coarse screen, a 500 mesh screen 24 to contain the beads, a 400 mesh screen 22 to absorb most of the impact of the carrier beads (and protect the 500 mesh screen from damage), and a flat rubber washer 20 to seal the cage. The choice of 400 mesh coarse screen and 500 mesh filter screen, while preferred, is dependent on the carrier size distribution and the toner size distribution, it should be understood that larger or smaller particles of both toner and carrier will affect the choice of the screen sizes. Also, while the preference of steel wire screens over nylon, polyester, fabric, etc., is based on the percent of open area, the efficiency of the toner removal and a desire to limit the amount of filter screen area to which the free toner could stick (and effect measurement), any of the aforementioned screens will produce usable results.

In FIG. 3, a portable vacuum source 30 that is part of the heretofore mentioned field measurement kit is shown connected to the bottom end of conductive plastic cage 12 through a hose 32 with the bottom of cage 12 resting on a grounded conductive pin 34 to ensure complete removal of toner. The field measurement kit also contains a conventional digital portable scale that has a 1 mg resolution.

In practicing field measuring of TC, a sample of toner/carrier of about 1.5+ grams is obtained from a developer housing of a machine and placed into cage 12 which is connected to vacuum source 30 to vacuum the toner off the carrier. The digital scale will allow the technical representative to measure the weight of the empty cage, the developer sample in the cage, and the detoned carrier in the cage. Then, using a look-up table, a toner concentration value is determined and used to adjust the calibration of an in-situ toner concentration sensor in software or to validate the current reading from the sensor.

It should now be understood that a method and apparatus for obtaining TC measurement in the field is disclosed that employs a novel venturi shaped container that when connected to vacuum pressure from a portable vacuum cleaner takes advantage of cyclone separator functionality to assist in separation of fine toner from carrier beads with the toner being caught in the vacuum cleaner and the carrier beads being caught by a plurality of screens covering an opening in the bottom of the container. Once this is accomplished, TC can be calculated by using the formula TC (%)=100×(wt of developer & container−wt of carrier & container)/(wt of carrier & container−wt of container).

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A toner concentration field measurement tool, comprising;

a portable container, said container being adapted to hold a sample of developer consisting of toner particles and carrier beads electrostatically attached to each other and having a first opening in a top portion thereof and a second opening in a bottom portion thereof with a device that includes multiple screens positioned thereover and a throat portion thereof that is narrower than said first opening and configured so that a vortex is created when vacuum pressure is applied to said first opening in said top portion of said container, and wherein said created vortex overcomes said electrostatic attachment and separates said toner particles from said carrier beads by accelerating airflow through said throat portion of said portable container, such that, when said toner particles and carrier beads collide with said device and each other said toner particles are stripped from said carrier particles.

2. The tool of claim 1, wherein said throat portion of said container is configured to be narrower than said first opening.

3. The tool of claim 2, wherein said container includes a cylindrical portion that is wider than any other portion of said container.

4. The tool of claim 3, wherein said multiple screens includes a coarse screen positioned over said second opening thereof and used to support other of said multiple screens and give stability to said device.

5. The tool of claim 4, including a washer positioned on top of said coarse screen.

6. The tool of claim 5, including a filter positioned on top of said washer and adapted to contain said carrier beads and allow toner particles to pass out of said container, and wherein said washer is adapted to protect said filter from sharp edges of said coarse screen during said created vortex.

7. The tool of claim 6, including a mesh screen positioned on top of said filter to absorb impact of said carrier beads during said created vortex, strip toner from said carrier beads and protect said filter from damage.

8. The tool of claim 7, including a seal positioned on top of said mesh screen to seal said container and prevent any carrier beads from escaping around said filter.

9. The tool of claim 1, wherein said container is venturi shaped.

10. The tool of claim 8, including a portable vacuum source including a hose adapted to be connected to said cylindrical portion of said container.

11. The tool of claim 10, wherein said container is plastic.

12. The tool of claim 11, wherein said plastic container is conductive.

13. The tool of claim 12, wherein said hose is grounded.

14. The tool of claim 11, wherein said cylindrical portion of said container provides volume for about 1-3 g sample of developer.

15. The tool of claim 13, wherein said throat portion of said container is narrowed to accelerate airflow that will strip toner from carrier beads.

16. The tool of claim 6, wherein said filter is steel.

17. The tool of claim 7, wherein said mesh screen is steel.

18. The tool of claim 8, wherein said seal is rubber.

19. The tool of claim 7, wherein said mesh screen is 400 steel.

20. An apparatus for measuring toner concentration separate from a printing apparatus, comprising;

a portable container, said container being adapted to hold a sample of developer consisting of toner particles and carrier beads that are electrostatically attracted to each other, said portable container having a first opening in a top portion thereof and a second opening in a bottom portion thereof and a throat portion thereof that is narrower than said first opening and configured such that a vortex is created when vacuum pressure is applied to said first opening in said top portion of said container, and wherein said portable container includes a combination device having a coarse screen positioned over said second opening that provides support and stability to said combination device, a washer positioned on top of said coarse screen, a filter positioned on top of said washer and adapted to contain said carrier beads and allow toner particles to pass out of said portable container, and wherein said washer is positioned to protect said filter from being torn by contact with said coarse screen, a mesh positioned on top of said filter for stripping toner from said carrier beads and protecting said filter from carrier bead damage, and a seal positioned on top of said mesh to prevent carrier beads from escaping around said filter, such that said created vortex overcomes said electrostatic attraction and separates said toner particles from said carrier beads by accelerating said toner particles and carrier beads such that when they collide with said filter and each other said toner particles are stripped from said carrier beads.

* * * * *